US006910406B1

(12) United States Patent
Schwarzkopf et al.

(10) Patent No.: US 6,910,406 B1
(45) Date of Patent: Jun. 28, 2005

(54) AXIAL PISTON COMPRESSOR

(75) Inventors: Otfried Schwarzkopf, Magstadt (DE); Ullrich Hesse, Affalterbach (DE)

(73) Assignee: Zexel Valeo Compressor Europe GmbH, Weiterstadt (DE)

( * ) Notice: Subject to any disclaimer, the term of this patent is extended or adjusted under 35 U.S.C. 154(b) by 112 days.

(21) Appl. No.: 10/129,721

(22) PCT Filed: Nov. 10, 2000

(86) PCT No.: PCT/EP00/11135

§ 371 (c)(1),
(2), (4) Date: Aug. 9, 2002

(87) PCT Pub. No.: WO01/36823

PCT Pub. Date: May 25, 2001

(30) Foreign Application Priority Data

Nov. 12, 1999 (DE) ..... 199 54 570

(51) Int. Cl.[7] ..... F01B 3/02
(52) U.S. Cl. ..... 92/71; 92/154
(58) Field of Search ..... 92/70, 71, 154

(56) References Cited

U.S. PATENT DOCUMENTS 4,221,544 A * 9/1980 Ohta ..... 417/269
4,283,997 A 8/1981 Takahashi et al.
5,518,374 A 5/1996 Ota et al.
5,947,698 A * 9/1999 Ikeda et al. ..... 92/71
6,015,269 A * 1/2000 Ota et al. ..... 417/269
6,129,532 A * 10/2000 Kato et al. ..... 417/269

FOREIGN PATENT DOCUMENTS

DE 196 21 174 A1 11/1997
DE 197 23 628 A1 12/1997
DE 198 00 556 A1 8/1998
DE 198 21 265 A1 1/1999
DE 199 07 492 A1 8/1999
EP 0 738 832 A1 10/1996

* cited by examiner

*Primary Examiner*—F. Daniel Lopez
(74) *Attorney, Agent, or Firm*—Andrus, Sceales, Starke & Sawall, LLP

(57) ABSTRACT

In an axial piston compressor for a refrigerant, in particular for a vehicle air conditioner, with a housing (12) in the interior of which is disposed at least one bearing (22, 24, 26, 48, 56, 58, 60, 64), with an output conduit (34) for the compressed refrigerant, and with a lubricant that is present in the interior of the housing (12), the lubrication is to be improved. For this purpose there is provided in the housing at least one lubricant channel to conduct lubricant to the bearing, as well as a lubricant separator (36) that is connected to the output conduit (34) for the refrigerant and incorporates a collection chamber (40) that contains the lubricant separated from the compressed refrigerant and is connected to the lubricant channel (46) by a feed line (42), such that the lubricant is propelled out of the lubricant separator and into the lubricant channel entirely on the basis of the pressure difference between the compression pressure of the lubricant and the interior pressure of the housing.

4 Claims, 3 Drawing Sheets

AXIAL PISTON COMPRESSOR

DESCRIPTION

Figure 1:
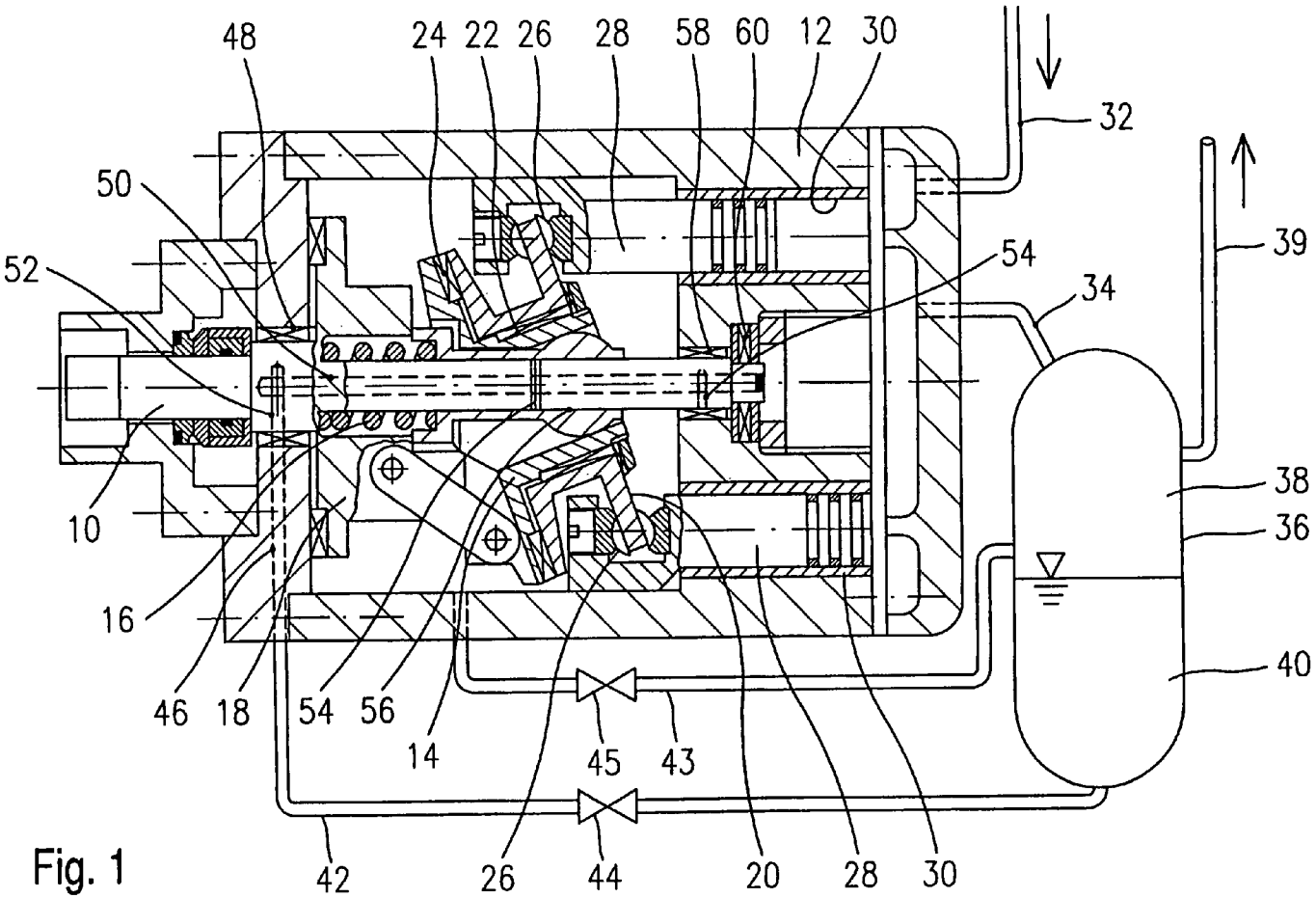

The invention relates to an axial piston compressor for a refrigerant, in particular for a vehicle air conditioner, with a housing in the interior of which at least one bearing is disposed, with an outlet conduit for the compressed refrigerant, and with a lubricant present within the interior of the housing.

Such an axial piston compressor is known, for example, from the German patent DE 196 21 174 A1. It is used to compress the refrigerant in a vehicle air conditioner and serves to suck in the refrigerant from a heat-transfer compartment in which it evaporates while taking up heat at low pressure, and to compress it to a higher pressure at which it is passed into another heat-transfer compartment where, while releasing heat, the refrigerant is returned to the liquid state and/or cooled.

Such compressors have been produced in a great variety of constructions; for various reasons, the most generally accepted axial piston compressors are those that operate with a swash plate. In this construction the axial movement of the piston is generated by a swash plate, tilted relative to the drive shaft at an angle that can be controlled. The pistons are connected to the swash plate so that they cannot be shifted by forces of compression or traction; because the cylinders within which the pistons move are fixed in place while the swash plate is in motion, as a coupling mechanism between the swash plate and the pistons there are provided either sliding blocks supported in sliding bearings situated on the pistons, or a wobble plate with piston rods seated on sliding bearings on the pistons. When the pistons are directly connected to the swash plate, on each piston there are formed two hemispherical bearings in which the two sliding blocks are disposed so that each contacts a slideway, one on one side of the swash plate and the other on the other side. In contrast, when a wobble plate is used, it is mounted on the swash plate so that it can be rotated with respect thereto, so that what is transmitted to the wobble plate is only the angle of tilt of the swash plate but not its rotational movement. The piston rods are seated on both the wobble plate and the piston by way of ball-and-socket joints.

In the case of axial piston compressors employed in motor vehicles, it is impossible to lubricate their components by circulating oil with a pump. For one thing, the axial piston compressor can in some circumstances become much more expensive when a lubricant pump is included. Furthermore, such a pump impairs performance, which in the case of an axial piston compressor for cooling vehicles, which tends to have a low output at best, is more significant than in the case of a higher-output axial piston compressor. Finally, the volume of the overall structure would be considerably increased by providing a pump that has to suck the lubricant in from an oil sump, and by the sump itself. For all these reasons the lubrication in the interior of the housing is accomplished not by a pump-driven circulation of oil but rather by a mist of oil generated within the housing. Furthermore, it is known from the European patent application 0 738 832 that an oil sump can be employed to collect oil droplets that are produced in the interior of the housing. This oil sump is connected to a reservoir in the interior of the housing by way of a lubricant-oil channel. Because the oil sump is positioned above the corresponding reservoir, the oil flows into the reservoir under the influence of gravity.

The situation is quite similar in the case of the axial piston compressor according to the patent DE 198 21 265 A1.

There, too, gravity causes oil to drop onto moving parts within a wobble-plate chamber. Accordingly, this construction also allows the bearings to be lubricated without applying pressure.

The same applies to the construction according to the patent U.S. Pat. No. 4,283,997. Although in this case oil is separated out on the high-pressure side and sent from there to the bearings of the moving parts of the axial piston compressor, there is a throttle behind the oil separator on the high-pressure side, and furthermore the oil channel opens into an oil-collecting chamber connected to the drive-mechanism chamber by way of a radial bearing for the drive shaft. Therefore the pressure of the lubricant oil falls nearly to the same level as that in the drive-mechanism chamber, with the consequence that the supply of lubricant oil to the bearings is considerably reduced. This construction, too, is thus distinguished by a nearly unpressurized application of lubricant.

However, the previously provided means of lubrication, by a mist of oil or by the application of lubricant without pressure, is not satisfactory under all operating conditions. In particular in the case of sliding bearings, which involve only a slight amount of oscillatory relative movement, the lubrication can be deficient because it is impossible to provide enough lubricant in the form of a mist.

The objective of the invention is thus to lubricate the bearings of an axial piston compressor of the kind described above with pressurized oil, reliably and by the simplest means, with no need for a separate oil pump. Nevertheless, the lubrication thus achieved is designed to be of higher quality than the lubrication of bearing sites by the lubricant mist present in the interior of the housing.

ADVANTAGES OF THE INVENTION

An axial piston compressor of the kind cited above with the features given in the characterizing part of claim 1 offers the advantage that a pressurized lubricant circulation is created that can conduct the required lubricant to the bearing sites in the interior of the housing. Expressed simply, this lubricant circulation is based on recycling the amount of lubricant that unavoidably leaves the axial piston compressor along with the compressed refrigerant, as well as on utilizing the pressure difference between the compressor side and the interior of the housing of the axial piston compressor. Because the pressure on the compressor side is much greater than that in the interior of the housing, the resulting throughput of lubricant is very high, with no need to provide a separate energy source or even a pump for the purpose. The lubricant separator provided in accordance with the invention is a comparatively simple component, which involves no great expenditure.

Within the lubricant circulation so created a suitable throttling ensures the resistance necessary to prevent the lubricant from flowing out of the separator too rapidly. Such throttling results automatically, for example, when a sliding bearing is being lubricated; the narrow gap in the bearing limits the rate at which lubricant can flow through. In contrast, when a roller bearing is being lubricated, in some circumstances a cover plate must be used to restrict the flow cross section by a suitable amount.

The construction in accordance with the invention thus is characterized by the fact that even the last bearing to be supplied with lubricant is supplied under high pressure, i.e. compression pressure. This is achieved because the bearings themselves represent throttling sites towards the low-pressure side; that is, they are either sealed off towards the low-pressure side or on the basis of their construction—this applies in particular to sliding bearings—constitute an extremely efficient throttle towards the low-pressure side. The oil pressure is applied to the bearing or gap in the bearing. With respect to their supply of lubricant oil, the bearings are arranged in series such that the pressure of the oil supplied to even the last bearing is nearly unchanged, i.e. is still high. Only on the basis of this construction is it possible to replace an oil pump by an oil separator on the high-pressure side, without impairing the supply to the bearings of oil under high pressure.

When both sliding and roller (in particular needle) bearings are employed, preferably the oil is first sent to the sliding bearings with "narrow gaps", because sliding bearings on account of their construction serve as efficient throttling sites towards the low-pressure side. In case the construction is such that roller or needle bearings must come first in the series, these should be sealed off towards the low-pressure side. In the sense of the above explanation, at the core of the present invention is the fact that the lubricant is propelled from the lubricant separator to the lubricant channel entirely on the basis of the pressure difference between the compression pressure of the refrigerant and the internal pressure of the housing, and is conducted by the channel under corresponding pressure to the bearings. This means that all the bearings are supplied with lubricant under high pressure, with no need for a separate oil pump.

In this arrangement, the lubricant separator is disposed on the pressure side of the circulation, either between the compressor and a pressure-side heat exchanger or between the pressure-side heat exchanger and an expansion valve.

According to one preferred embodiment of the invention, the feed line is provided with a controllable valve. With this valve the feed line can be closed while the axial piston compressor is not operating, so that the high pressure on the compressor side cannot press the lubricant that is within the collection chamber out into the housing of the axial piston compressor and thereby eventually empty the collection chamber. If that were to happen, no lubricant would be available when the axial piston compressor was put into operation. On the other hand, if the valve is opened as soon as the axial piston compressor becomes operative, the compressor can be adequately lubricated immediately, by the lubricant that has accumulated in the collection chamber.

The controllable valve could be eliminated if outflow of the lubricant from the collection chamber were counteracted by a sufficient resistance, namely the internal resistances and throttling sites of the system. That is, if the compressor is only briefly inoperative, there is not enough time for equilibration of the pressures on the high- and low-pressure sides of the compressor. Hence when the compressor is turned on again, it must work against a high pressure; in compensation, however, lubricant is immediately available. On the other hand, after the compressor has been inactive for a long time, so that the pressures have equilibrated and pressurized lubricant is not delivered immediately, it takes some time for the pressure to be built up; that is, the compressor is initially not working under a heavy load, so that complete lubrication is not immediately required. As the load on the compressor increases, the lubrication improves accordingly.

Alternatively, the controllable valve could be replaced by a throttling site, if it is ensured that the pressure equilibration during compressor standstill is brought about primarily by other parts of the circulation system, for example by a separate valve.

Instead of a separate throttling site, a throttle conduit could be used, in which the required throttling is produced by the various pressure losses in the lubricant supply system, in particular by channels in the compressor.

Preferably an overflow conduit is provided, which connects the lubricant separator to the interior of the housing. By this means excess lubricant that has accumulated in the collection chamber can be removed when necessary. For this purpose a controllable valve can be provided in the overflow conduit, which is opened in dependence, for example, on the signal from a sensor that detects the level of the contents in the collection chamber.

According to one embodiment of the invention it can be provided that the lubricant separator is integrated into the housing. This enables a particularly compact construction.

Alternatively, it can be provided that the lubricant separator is separate from the housing and the feed line acts as a lubricant cooler. This ensures that the lubricant fed back to the bearing sites, which has been warmed by the refrigerant during the compressor stroke, is returned to its initial temperature.

According to one preferred embodiment, a drive shaft with an axial distributor bore is provided. An axial distributor bore in the drive shaft enables nearly all the important bearing sites in the interior of the housing of the axial piston compressor to be reached with a particularly simple arrangement. The complexity in this case is distinctly less than in the case of an arrangement such that individual lubricant channels are provided for all the bearing sites in the compressor housing.

Preferably the distributor bore opens at an end face of the drive shaft situated in the interior of the housing, i.e. the face at the end opposite to the drive end of the drive shaft. Given an axial delivery route of the lubricant, because of the low circumferential velocities a small axial sealing element can be used, so that the whole structure can be made compact. According to a preferred embodiment a swash plate is provided that is disposed on the drive shaft so that it can move along a sliding bearing, and in the region of the sliding bearing a branch bore is provided in the drive shaft to connect the sliding bearing with the distributor bore. The sliding bearing is very difficult to lubricate by means of the lubricant mist present in the interior of the housing; the branch bore makes it possible to conduct the necessary amount of lubricant to the sliding bearing. The amount thus conducted can be determined by adjusting the cross-sectional area of the branch bore.

Preferably a supply bore is formed within the swash plate, into which lubricant passing through the sliding bearing flows, so that sliding blocks in contact with the swash plate can be supplied with lubricant by way of the supply bore. By this means the sliding blocks, which move with only a slight oscillatory component and hence are difficult to lubricate by means of a lubricant mist, are supplied in a targeted manner with pressurized lubricant.

According to a preferred embodiment the drive shaft is seated in at least one subassembly comprising radial and axial bearings, this subassembly being supplied with lubricant by a branch bore from the drive shaft such that the lubricant flows first through the radial bearing and then through the axial bearing. This sequential arrangement of the bearings with respect to the lubricant flow makes it possible for both bearings to be lubricated in a relatively uncomplicated manner. Because the space available limits the size of the radial bearing, this bearing is likely to have the shortest working life and hence is the first to be supplied with lubricant; the lubricant flowing out of the radial bearing is then sent to the axial bearing. As is preferably the case, this order of lubrication can be produced by sealing disks that form leakage gaps of specified dimensions. By suitably dimensioning the sites through which the lubricant passes, the function of a non-controllable valve can be simulated, so that when the compressor is not operating, it is impossible for too much lubricant to be transferred from the separator into the compressor.

According to one preferred embodiment of the invention, $CO_2$ is used as the refrigerant. Apart from various technical advantages of $CO_2$ in comparison to conventionally employed refrigerants such as R134a, an air conditioner with $CO_2$ as refrigerant operates at a much higher pressure than does an air conditioner with a conventional refrigerant. When $CO_2$ is used, the suction pressure is about 50 bar and the compression pressure, about 120 bar. In contrast, the suction pressure for the refrigerant R234a is about 5 bar and the compression pressure, about 20 bar. As a result, when $CO_2$ is used as the coolant the pressure difference between the lubricant separator and the interior of the housing of the axial piston compressor is much greater than in conventional axial piston compressors, namely about 70 bar as compared with 15 bar. This increase in pressure differential in accordance with the invention produces an improved supply of lubricant to the bearings.

Advantageous embodiments of the invention will be apparent from the subordinate claims.

DRAWINGS

Figure 2:
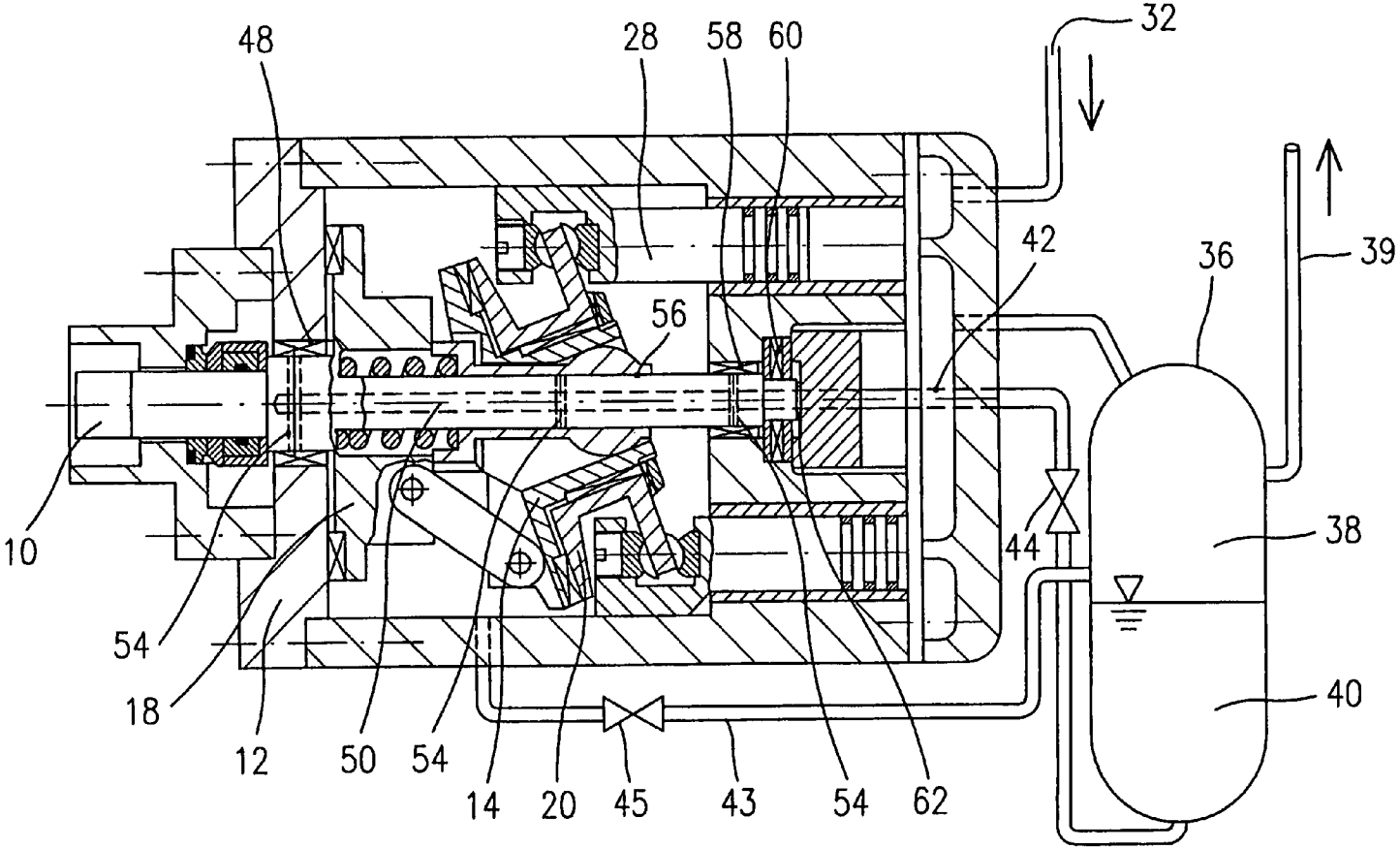
Figure 3:
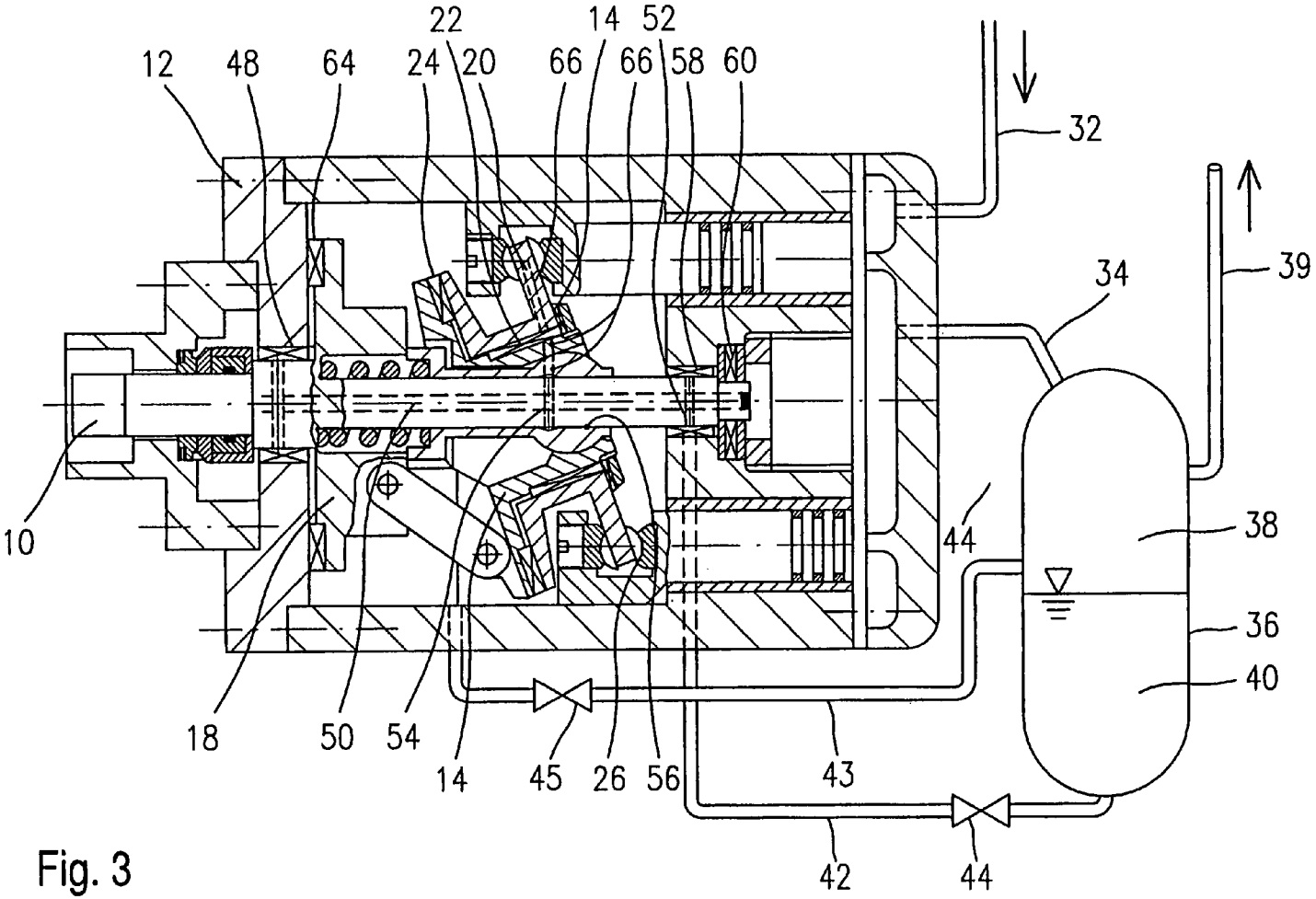

In the following the invention will be described with reference to various embodiments illustrated in the attached drawings, wherein FIG. 1 is a schematic sectional view of an axial piston compressor according to a first embodiment of the invention;

FIG. 2 shows a schematic section of an axial piston compressor according to a second embodiment of the invention; and FIG. 3 shows a schematic section of an axial piston compressor according to a third embodiment of the invention.

DESCRIPTION OF THE EXEMPLARY EMBODIMENTS

In FIG. 1 an axial piston compressor according to a first embodiment is shown schematically. It comprises a drive shaft 10 seated in a housing 12. To the drive shaft 10 there is nonrotatably connected a swash plate 14, which can be pivoted between a position in which it is approximately perpendicular to the long axis of the drive shaft 10 and a maximally tilted position shown in FIG. 1. The position occupied by the swash plate 14 while in operation is adjusted in dependence on the difference between the intake pressure of the compressor and the pressure in the interior of the housing 12 as well as on the pretensioning of a spring 16 that can shift the swash plate along the drive shaft 10; the swash plate is braced against a holder 18 so that as it is shifted along the drive shaft, it is also pivoted.

A wobble plate 20 is rotatably seated on the swash plate by means of radial and axial roller bearings 22, 24. Engaged with the wobble plate 20 are several ball-and-socket joints 26, each of which provides a tension- and pressure-resistant connection between a piston 28 and the wobble plate 20. Each piston 28 can move within a cylinder 30, the central axis of which is parallel to the long axis of the drive shaft 10. In the drawing only two pistons are shown; in fact, the compressor can contain as many as seven pistons.

When the drive shaft 10 is put into rotation and the swash plate is tilted with respect to the drive shaft, each piston 28 moves back and forth within its cylinder 30. This movement can be utilized to compress a refrigerant, for example $CO_2$. Under evaporative or suction pressure, the refrigerant is extracted from an input conduit 32, and under condensation or evaporation pressure it is sent into an output conduit 34. During the compression process the refrigerant takes up small amounts of a lubricant that is present in the interior of the housing and is also deposited on the inner wall of the cylinder 30.

The output conduit 34 opens into a lubricant separator 36. This comprises, firstly, a separator compartment 38 in which the flow velocity of the refrigerant, which is present as a pressurized gas, is lowered and as a result the lubricant is separated out by the force of gravity; in addition it comprises a chamber 40 in which the separated lubricant is collected. The lubricant contained in the collection chamber 40 is under the pressure of the refrigerant. From the separator compartment 38, the compressed refrigerant is conducted to a heat exchanger through a compressor conduit 39.

As an alternative to a gravity separator, in principle any generally used means of separation can be used to implement the lubricant circulation.

Attached to the lowest part of the collection chamber 40 is a feed line 42, which is provided with a controllable valve 44. The feed line 42 leads to a supply channel 46 in the housing 12, which opens into a radial bearing 48 for the drive shaft 10. To the separator compartment 38 is attached an overflow conduit 43, provided with a valve 45. Opening of the valve 45 enables an excess volume of lubricant contained in the collection chamber 40 to be returned to the housing.

The drive shaft 10 is provided with a distributor bore 50 that extends axially and is connected by way of a radially extending supply bore 52 to the radial bearing 48. The drive shaft 10 is further provided with two radially extending branch bores 54, one of which is associated with a sliding bearing 56 by means of which the swash plate is seated on the drive shaft 10, while the other is associated with a radial bearing 58 which, together with an axial bearing 60, supports the end of the drive shaft 10 disposed in the interior of the housing 12, namely the end opposite the drive end of the shaft.

When during operation of the axial piston compressor described here the valve 44 of the feed line 42 is opened, the lubricant contained in the collection chamber 40 flows through the feed line 42 to the supply channel 46, because of the difference between the pressure in the separator compartment 38 and the interior of the housing 12. From the supply channel it flows into the distributor bore 50 of the drive shaft 10, by way of the radial bearing 48 and the supply bore 52. From the distributor bore it can reach the various bearing sites in the interior of the housing by way of the branch bores 54. In this way the sliding bearing 56 as well as the subassembly consisting of radial bearing 58 and axial bearing 60 are lubricated. The radial bearing 58 is so constructed that the lubricant that has flowed through it continues to the axial bearing. For this purpose, the radial bearing can be integrated into the housing in such a way that a projection of the housing, together with the rotating drive shaft, forms a narrow gap that allows only as much lubricant to escape as can ensure an acceptable lubricant pressure throughout the entire "serial arrangement" of bearing sites.

That the lubricant introduced to the interior of the housing will be returned to the lubricant separator is ensured by the fact that, because of the rotation of the components of the axial piston compressor, a mist of lubricant is always present in the interior of the housing. This is deposited on the inner wall of the cylinder 30, and from there it is carried by the compressed refrigerant into the lubricant separator.

In FIG. 2 a second embodiment of an axial piston compressor is diagrammed. For the components already described in the first embodiment the same reference numerals are used here, so that the explanations given above also apply here.

In contrast to the first embodiment, in the second embodiment the lubricant is conducted axially in the distributor bore 50 within the drive shaft 10, having been introduced at the end of the drive shaft that is on the right in FIG. 2. For this purpose, on the end face of the drive shaft 10 a sealing element 62 is provided, which can have small dimensions because the circumferential velocity there is so low.

In this embodiment, a branch bore 54 is now provided in the region of the radial bearing 48 associated with the drive end of the drive shaft, so that this bearing is reliably provided with lubricant. From this bearing the lubricant flows to an axial bearing 64, which supports the holder 18.

FIG. 3 is a diagram of an axial piston compressor according to a third embodiment. Here, again, for known components the same reference numerals are used as in FIG. 1, so that for these reference is made to the explanations given above.

Here the lubricant is conducted radially, as in the first embodiment, but it is introduced in the region of the radial bearing 58. From there it can flow through the distributor bore 50 to the sliding bearing 56 and the radial bearing 48.

A difference from the first embodiment is that in the third embodiment a supply bore 66 is provided both in the swash plate 14 and in the wobble plate 20. Hence the lubricant emerging from the branch bore 54 can pass through the sliding bearing 56, the radial bearing 22 and the wobble plate 20 to reach the ball-and-socket joints 26 and lubricate the latter, in particular the sliding blocks disposed in the ball-and-socket joints.

It is also possible to supply the pistons 28 in the cylinders 30 with pressurized oil, so as to produce a better film of lubricant in the region of the friction pairing there, which can be regarded as a sliding bearing. For this purpose, a lubricant pocket is formed in the cylinder face, which is supplied with lubricant through a suitable channel. The narrow gap between cylinder and piston ensures the required throttling of the lubricant throughput.

LIST OF REFERENCE NUMERALS

10 Drive shaft
12 Housing
14 Swash plate
16 Spring
18 Holder
20 Wobble plate
22 Roller bearing
24 Roller bearing
26 Ball-and-socket joint
28 Piston
30 Cylinder
32 Input conduit
34 Output conduit
36 Lubricant separator
38 Separator compartment
39 Compressor conduit
40 Collection chamber
42 Feed line
43 Overflow conduit
44 Valve
45 Valve
46 Supply channel
48 Radial bearing
50 Distributor bore
52 Supply bore
54 Branch bore
56 Sliding bearing
58 Radial bearing
60 Axial bearing
62 Sealing element
64 Axial bearing
66 Supply bore

What is claimed is:

1. Axial piston compressor for a refrigerant, in particular for a vehicle air conditioner, with a housing (12) in the interior of which is disposed at least one bearing (22, 24, 26, 28, 30, 48, 56, 58, 60, 64), with an output conduit (34) for the compressed refrigerant, and with a lubricant that is present in the interior of the housing (12), characterized in that in the housing at least one lubricant channel (46) is provided to conduct lubricant to the bearing, as well as a lubricant separator (36) that is connected to the output conduit (34) for the refrigerant and incorporates a collection chamber (40) to contain the lubricant separated from the compressed refrigerant, and in that a feed line (42) having a controllable valve (44) is provided to connect the collection chamber to the lubricant channel (46), wherein the lubricant is propelled out of the lubricant separator and into the lubricant channel entirely on the basis of the pressure difference between the compression pressure of the lubricant and the interior pressure of the housing, and is conducted through the channel to said bearing (48, 56, 58, 60, . . . ) under correspondingly high pressure.

2. Axial piston compressor according to claim 1, characterized in that an overflow conduit (43) is provided, which connects the lubricant separator (36) to the interior of the housing.

3. Axial piston compressor according to claim 2, characterized in that the overflow conduit (43) is provided with a controllable valve (45).

4. Axial piston compressor for a refrigerant provided with a drive shaft (10) containing an axial distributor bore (50), in particular for a vehicle air conditioner, with a housing (12) in the interior of which is disposed at least one radial and axial bearing (22, 24, 26, 28, 30, 48, 56, 58, 60, 64), with an output conduit (34) for the compressed refrigerant, and with a lubricant that is present in the interior of the housing (12), characterized in that the drive shaft is supported by at least one subassembly consisting of radial bearing (58) and axial bearing (60) provided with sealing discs that form a specified leakage gap (10) and that this subassembly is supplied with lubricant by a branch bore (54) in the drive shaft, such that the lubricant flows first through the radial bearing and then through the axial bearing.

* * * * *